US007311087B2

(12) United States Patent
Shaull et al.

(10) Patent No.: US 7,311,087 B2
(45) Date of Patent: Dec. 25, 2007

(54) FUEL PUMP WITH A GUIDED TAPPET ASSEMBLY AND METHODS FOR GUIDING AND ASSEMBLY

(75) Inventors: Anthony A. Shaull, Columbus, IN (US); Wesley R. Thayer, Columbus, IN (US)

(73) Assignee: Cummins Inc., Columbus, IN (US)

( * ) Notice: Subject to any disclaimer, the term of this patent is extended or adjusted under 35 U.S.C. 154(b) by 387 days.

(21) Appl. No.: 10/994,291

(22) Filed: Nov. 23, 2004

(65) Prior Publication Data

US 2006/0110273 A1 May 25, 2006

(51) Int. Cl.
*F02M 37/04* (2006.01)

(52) U.S. Cl. ..... 123/509; 123/495; 417/470

(58) Field of Classification Search ..... 123/509, 123/508, 507, 495; 417/470; 92/129
See application file for complete search history.

(56) References Cited

U.S. PATENT DOCUMENTS

| | | | | |
|---|---|---|---|---|
| 1,802,330 | A | 4/1931 | Boland | |
| 2,372,694 | A | 4/1945 | Tabb | |
| 3,668,945 | A * | 6/1972 | Hofmann | 74/569 |
| 3,822,683 | A | 7/1974 | Clouse | |
| 3,977,370 | A | 8/1976 | Humphreys | |
| 4,167,926 | A | 9/1979 | Leblanc et al. | |
| 4,173,954 | A | 11/1979 | Speckhart | |
| 4,464,099 | A * | 8/1984 | Mowbray | 417/510 |
| 4,617,903 | A | 10/1986 | Heberle et al. | |
| 4,809,651 | A | 3/1989 | Gerchow et al. | |
| 4,842,497 | A | 6/1989 | Hafele et al. | |
| 5,007,401 | A * | 4/1991 | Grohn et al. | 123/509 |
| 5,022,356 | A | 6/1991 | Morel, Jr. et al. | |
| 5,307,769 | A | 5/1994 | Meagher et al. | |
| 5,307,778 | A | 5/1994 | Hummel et al. | |
| 5,415,533 | A | 5/1995 | Egger et al. | |
| 6,196,175 | B1 | 3/2001 | Church | |
| 6,406,269 | B1 | 6/2002 | Dingle et al. | |
| 6,427,652 | B2 | 8/2002 | Faria et al. | |
| 6,513,470 | B1 | 2/2003 | Hendriksma et al. | |
| 6,626,148 | B1 * | 9/2003 | Cooke et al. | 123/447 |
| 6,799,954 | B2 * | 10/2004 | Ikegami et al. | 417/470 |
| 6,910,407 | B2 * | 6/2005 | Furuta | 92/72 |
| 2005/0152797 | A1 * | 7/2005 | Sailer et al. | 417/470 |

* cited by examiner

*Primary Examiner*—Carl S. Miller
(74) *Attorney, Agent, or Firm*—Nixon Peabody LLP; Tim L. Brackett, Jr.; J. Bruce Schelkopf

(57) ABSTRACT

A fuel pump for an internal combustion engine including a fuel pump housing, a cylindrical bore having a central axis and being defined by a bore wall surface, a receiving hole formed in the housing, and a tappet assembly received in the cylinder bore. The tappet assembly includes an outer peripheral surface with an elongated key slot longitudinally extending parallel to the central axis. A guide key partially received in the receiving hole is provided, the guide key including a head that extends into the cylindrical bore to engage the elongated key slot of the tappet assembly. The head has an outer dimension that is larger than a dimension of the receiving hole along the central axis. Methods for guiding a reciprocating tappet assembly in a fuel pump and assembling a fuel pump are also provided.

25 Claims, 3 Drawing Sheets

FUEL PUMP WITH A GUIDED TAPPET ASSEMBLY AND METHODS FOR GUIDING AND ASSEMBLY

TECHNICAL FIELD

This invention relates to a fuel pump with a guided reciprocating tappet assembly, and methods for guiding a tappet assembly and assembling a fuel pump.

BACKGROUND OF THE INVENTION

Various fuel pumps that are used to provide fuel to internal combustion engines are driven by a lobed camshaft that displaces a tappet assembly with a roller that rolls along the cam lobe. The reciprocating motion of the tappet assembly generates fuel flow that is used by the internal combustion engine to generate power. These types of fuel pumps are popular in modern fuel systems, and are frequently used in common rail fuel systems applications where high fuel pressures are required. In such fuel pumps, the reciprocating tappet assembly is guided so that the centerline of the roller and the centerline of the camshaft are maintained in an aligned position with respect to each other.

Conventional fuel pumps utilize a solid dowel pin that is pressed into the housing of the fuel pump from the exterior of the fuel pump housing to maintain the rotational positioning of the tappet assembly relative to the camshaft lobe. In this regard, the housing of the fuel pump is generally provided with a hole that extends through the housing so that the dowel pin can be inserted. The roller tappet assembly typically includes a key slot into which the dowel pin extends, thereby allowing reciprocal displacement of the tappet assembly while preventing rotation of the roller tappet assembly relative to the camshaft.

U.S. Pat. No. 5,415,533 issued to Egger et al. discloses another example system and method of guiding a roller tappet assembly. A cylindrical disk is situated as a guide piece of a radial bore in a slide bush, and is secured in place by a wire ring that is guided in an external annular groove in the slide bush. The cylindrical disk is inserted from the exterior of the fuel injection pump through an opening in the slide bush. The cylindrical disk is pressed against a planar recess which runs perpendicular to the axis of the pump piston. The horizontal edges of the recess constrain the movement of the roller tappet assembly in the slide bush, while the vertical edges of the recess prevent the rotational position of the roller tappet assembly.

U.S. Pat. No. 3,822,683 issued to Clouse discloses still another system and method of guiding a roller tappet assembly in which the cylindrical member of a plunger assembly is reciprocally mounted in a cylindrical bore. The reference discloses that rotation of the cylindrical member is prevented by a key that engages a longitudinal slot axially formed on the cylindrical member.

As described in further detail below, various limitations have been noted in the above described systems and methods for guiding a tappet assembly that negatively impact the durability and reliability of the fuel pump. Therefore, there exists an unfulfilled need for a fuel pump and methods that minimize these limitations, and increase the durability and reliability of the fuel pump.

SUMMARY OF THE INVENTION

The above described fuel pumps that implement the tappet guides of the prior art have been found to fail for various reasons. In particular, during high speed or abusive use conditions, the pins that are inserted through an opening in the pump housing such as that described in U.S. Pat. No. 5,415,533 issued to Egger et al. can actually become loose and back out sufficiently. This can cause the tappet assembly to rotate in the bore so that the centerlines of the roller and the cam lobe no longer align. Such rotation of the tappet assembly generally results in catastrophic failure of the fuel pump.

The above described mode of failure may be avoided by providing a blind receiving hole, and inserting a solid dowel pin that prevents rotation of the tappet assembly into the blind receiving hole from the interior of the bore. The pin is trapped so as to prevent it from backing out once the tappet assembly is installed into the cylindrical bore. The disadvantage of such system and method of inserting the pin into a blind receiving hole is that it is difficult to accurately control the extent to which the pin is inserted into the receiving hole, and the extent to which the pin extends into the cylindrical bore. In particular, the pin should be inserted into the receiving hole so that it protrudes into the bore by a desired amount. If the pin protrudes too far out or too little, the guiding function of the pin may be impeded. Because the receiving hole is blind, the insertion of the pin into the receiving hole with the desired amount of the pin protruding is difficult to attain.

In addition, over time, the outer periphery of the pin, the guide slot of the tappet, and/or the opening of the receiving hole can wear due to the bending and contact stresses caused by the reciprocating movement of the tappet assembly. In particular, the pin exerts a cyclical force on the edge of the guide slot and/or the receiving hole, the cyclical force being caused by the reciprocating movement of the tappet assembly within the cylindrical bore. This causes bending and contact stresses, and corresponding wear, in the peripheral surface of the pin and/or the guide slot itself. This wear can also lead to failure of the fuel pump.

Thus, one aspect of the present invention is in providing a fuel pump including a reciprocating tappet assembly that is guided by a guide key with a head that reduces the contact stress exerted on the guide key, and distributes bending stress to the bore wall surface of the fuel pump to improve the durability and reliability of the fuel pump.

Another aspect of the present invention is in providing a method for guiding a reciprocating tappet assembly in a fuel pump that maintains the rotational positioning of the tappet assembly relative to a camshaft lobe.

Still another aspect of the present invention is in providing a method of assembling a fuel pump that includes a guide key in which proper assembly of the guide key is facilitated.

In accordance with one embodiment of the present invention, a fuel pump for an internal combustion engine includes a fuel pump housing, a cylindrical bore provided in the fuel pump housing, the cylindrical bore having a central axis and being at least partially defined by a bore wall surface of the fuel pump housing, and a receiving hole formed in the fuel pump housing that is open to the cylindrical bore. The fuel pump also includes a tappet assembly received in the cylindrical bore, the tappet assembly having an outer peripheral surface with an elongated key slot longitudinally extending parallel to the central axis of the cylindrical bore. A guide key is provided that is partially received in the receiving hole, the guide key including a head that extends into the cylindrical bore to engage the elongated key slot of the tappet assembly. The head has an outer dimension along the central axis of the cylindrical bore that is larger than a dimension of the receiving hole along the central axis.

In accordance with one embodiment, the head of the guide key includes at least one extension sized to be received in the elongated key slot. In another embodiment, the head of the guide key includes a support surface that contacts the bore wall surface. In another embodiment of the present invention, the receiving hole extends substantially perpendicular to the central axis. The guide key may include a body that is at least partially received in the receiving hole, the body of the guide key having an enlarged portion with a circular cross section and a diameter larger than a diameter of the receiving hole so that the guide key is pressed into the receiving hole. In this regard, the body of the guide key may also be implemented to further include a reduced portion having a circular cross-section with a diameter that is smaller than the diameter of the receiving hole, and a chamfer between the reduced portion and the enlarged portion. The guide key may be implemented in one embodiment to have a substantially T-shape in which the head includes two extensions that extend perpendicular to the body and extend diametrically opposed to one another in relation to the body. In still another embodiment of the present invention, the receiving hole may be implemented as a through-hole extending through the fuel pump housing. Alternatively, the receiving hole may be implemented as a blind hole open to the cylindrical bore.

In accordance with another aspect of the present invention, a method for guiding a reciprocating tappet assembly in a fuel pump is provided, the method includes providing a fuel pump housing with a cylindrical bore having a central axis and being at least partially defined by a bore wall surface of the fuel pump housing, forming a receiving hole in the fuel pump housing that is open into the cylindrical bore, and providing a guide key with a head that extends into the cylindrical bore, the head having an outer dimension along the central axis of the cylindrical bore that is larger than a dimension of the receiving hole along the central axis. The method also includes inserting at least a portion of the guide key into the receiving hole, and providing a tappet assembly received in the cylinder bore, the tappet assembly including an outer peripheral surface and an elongated key slot longitudinally extending parallel to the central axis of the cylinder bore. The rotational positioning of the tappet assembly is maintained by receiving the head of the guide key in the elongated key slot of the tappet assembly.

In accordance with one embodiment, the head may be provided with at least one extension that is slidably received in the elongated key slot to reduce contact stress exerted on the head as the tappet assembly is reciprocally displaced in the cylindrical bore. The head of the guide key may also be provided with a support surface, and the method may also include at least partially distributing bending stress exerted on the guide key to the bore wall surface through the support surface as the tappet assembly is reciprocally displaced in the cylindrical bore. In accordance with another embodiment, the method further includes pressing in the body of the guide key into the receiving hole.

In yet another aspect of the present invention, a method of assembling a fuel pump is provided, the method including providing a fuel pump housing with a cylindrical bore having a central axis and being at least partially defined by a bore wall surface of the fuel pump housing, forming a receiving hole in the fuel pump housing that is open into the cylindrical bore, and providing a guide key having a head, the head having an outer dimension along the central axis of the cylindrical bore that is larger than a dimension of the receiving hole along the central axis. The method also includes inserting the body of the guide key into the receiving hole in a manner that the head of the guide key extends into the cylindrical bore. The method further includes providing a tappet assembly including an outer peripheral surface and an elongated key slot extending longitudinally on the outer peripheral surface, and inserting the tappet assembly into the cylindrical bore with the key slot being positioned to receive the head of the guide key therein to maintain the rotational positioning of the tappet assembly. The head may be provided with at least one extension that is slidably received in the elongated key slot to reduce contact stress exerted on the head as the tappet assembly is reciprocally displaced in the cylindrical bore. The head of the guide key may be provided with a support surface, and the method may also include at least partially distributing bending stress on the guide key to the bore wall surface through the support surface as the tappet assembly is reciprocally displaced in the cylindrical bore.

These and other advantages and features of the present invention will become more apparent from the following detailed description of the preferred embodiments of the present invention when viewed in conjunction with the accompanying drawings.

DETAILED DESCRIPTION OF THE PREFERRED EMBODIMENT

Figure 1:
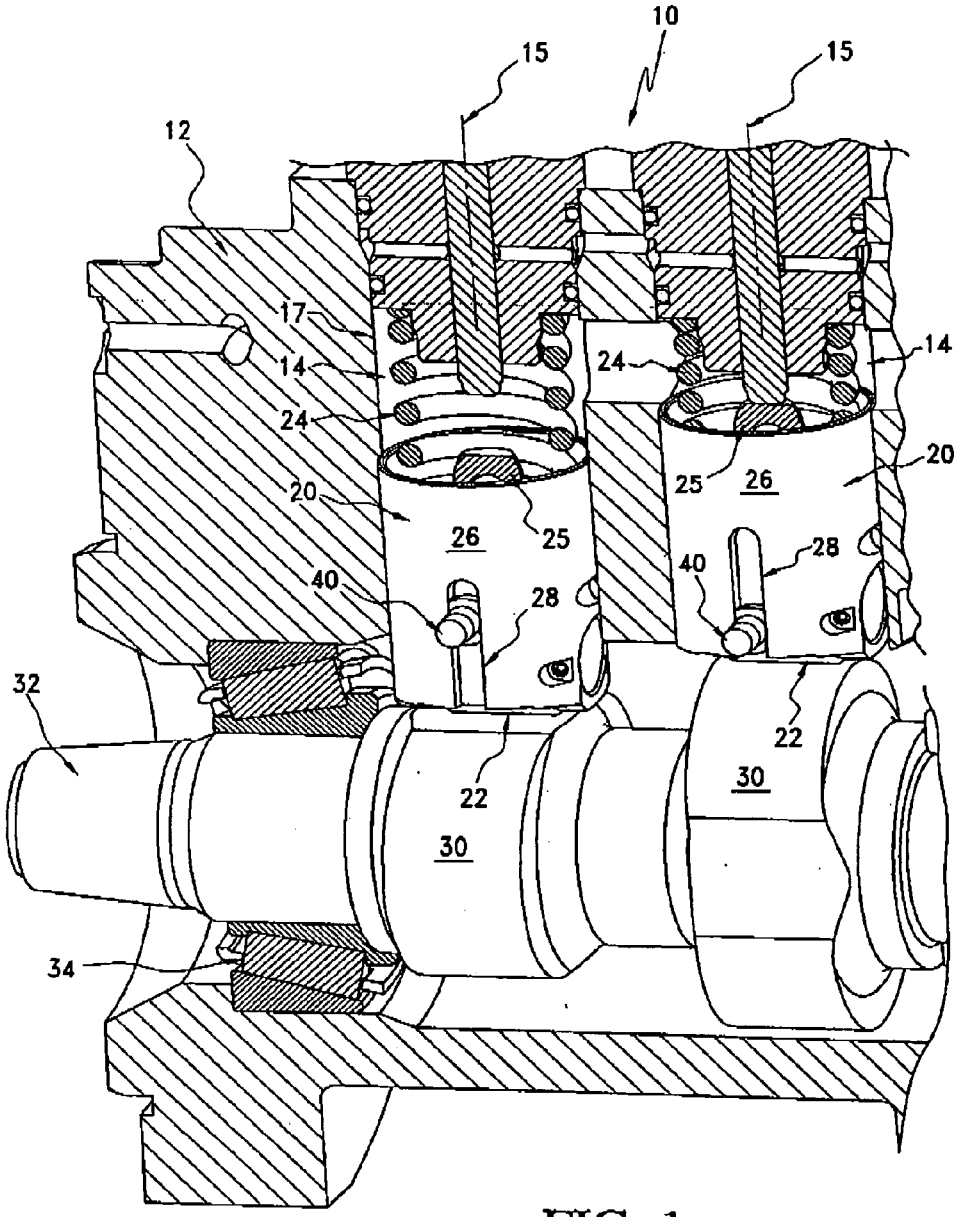
FIG. 1 is a partial cross-sectional view of a fuel pump in accordance with an example embodiment of the present invention.

FIG. 1 illustrates a partial cross-sectional view of a fuel pump 10 in accordance with one example embodiment of the present invention. As will be described in further detail below, the fuel pump 10 implements a novel method for guiding a reciprocating tappet assembly to maintain the rotational position of the tappet assembly. The features of the fuel pump 10 as described in further detail below, enhances the fuel pump's durability and reliability as compared to conventional fuel pumps. The specific details of the structure and operation of fuel pumps are generally known in the art, and are not critical for understanding the present invention. Correspondingly, detailed discussions relative to the fuel pump 10 itself, and its functions, are omitted herein.

The fuel pump 10 as shown in FIG. 1 includes a fuel pump housing 12 with cylindrical bores 14 that have a central axis 15 and corresponding bore wall surfaces 17 that at least partially define the cylindrical bores 14. Received in the cylindrical bores 14 are tappet assemblies 20 which are shown in a perspective, non-cross-sectional view in FIG. 1. It should be noted that whereas the illustrated embodiment of the fuel pump 10 shown in FIG. 1 is provided with two separate cylindrical bores and corresponding tappet assemblies, it should be evident that the illustrated fuel pump 10 is merely one example, and that the present invention may be implemented in other fuel pumps with one or any desired number of tappet assemblies.

The tappet assemblies 20 are adapted to reciprocate within the cylindrical bores 14 and allow fuel to be pumped by the fuel pump 10. In this regard, the tappet assemblies 20 include rollers 22 that contact, and roll along, the surfaces of cam lobes 30. The tappet assemblies 20 are biased toward the camshaft lobes 30 by biasing springs 24 that are positioned by spring retainers 25. The cam lobes 30 are provided on a camshaft 32 that is supported by bearing 34, and driven by an appropriate drive mechanism such as a pulley or gear of an internal combustion engine. In the conventional matter, as the camshaft 32 is rotated, the cam lobes 30 displace the tappet assemblies 20 within the cylindrical bores 14 for pumping the fuel, the tappet assemblies 20 being displaced in a reciprocating manner within the cylindrical bores 14 by the cam lobes 30, and the return action effectuated by the biasing springs 24.

As also shown in FIG. 1, the tappet assemblies 20 include outer peripheral surfaces 26 with elongated key slots 28 provided thereon. The elongated key slots 28 extend longitudinally parallel to the central axis 15 of the cylindrical bores 14 and in the present embodiment, extend to the outer edge of the tappet assemblies 20. The key slots 28 allow maintaining of the rotational position of the tappet assemblies 20 in the cylindrical bores 14, and thus, their position relative to the camshaft lobes 30. More specifically, guide keys 40, that are installed in the cylindrical bores 14 of the fuel pump housing 12, are slidably received in the key slots 28 of the tappet assemblies 20. As can be appreciated by examining FIG. 1, the receiving of the guide keys 40 in the elongated key slot 28 prevents the tappet assemblies 20 from rotating within the cylindrical bore 14, thereby maintaining the centrally aligned positioning of the tappet assemblies 20 relative to the cam lobes 30. It should be further recognized that because FIG. 1 is a partial cross-section of the field pump 10, the part of the fuel pump housing 12 that secures the guide keys 40 is not illustrated in FIG. 1, but instead, clearly illustrated in FIG. 2.

Figure 2:
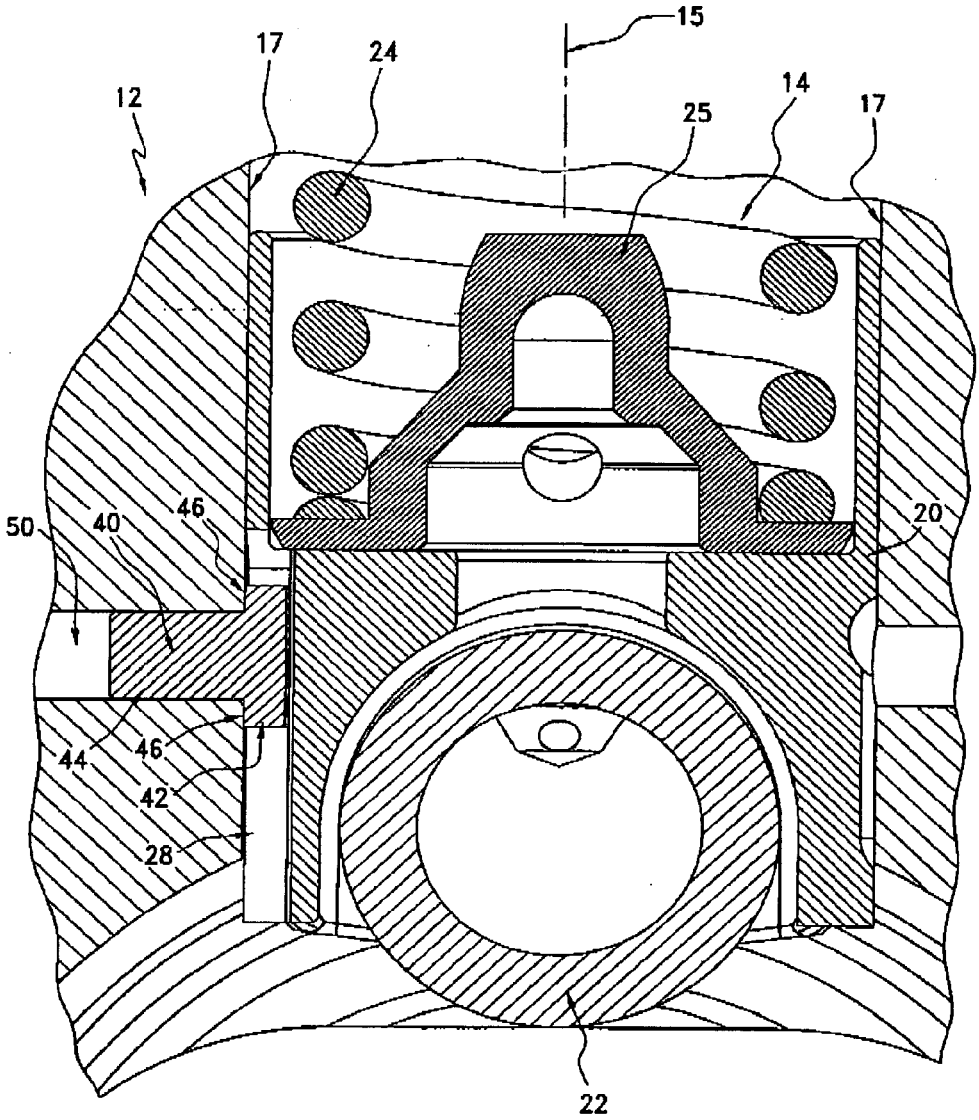
FIG. 2 is an enlarged cross-sectional view of a tappet assembly of FIG. 1 which is retained by the guide key in accordance with one example implementation of the present invention.

FIG. 2 shows a cross-sectional view of one tappet assembly 20 that is received in one cylindrical bore 14 of the fuel pump housing 12 in accordance with an example embodiment of the present invention. Cross-sectional view of FIG. 2 is taken along a central axis 15 shown in FIG. 1, bisecting the elongated key slot 28. As noted, the tappet assembly 20 includes the biasing spring 24 having a lower portion positioned against the spring retainer 25. The spring 24 biases the roller 22 toward the cam lobes 30.

As also shown most clearly in FIG. 2, the guide key 40 is received in the elongated key slot 28 so as to prevent rotation of the tappet assembly 20 in the cylindrical bore 14, thereby maintaining the central positioning of the tappet assembly 20 relative to the cam lobe 30 shown in FIG. 1. The guide key 40 in the illustrated embodiment has a substantially T-shaped cross-section including a head 42 that extends from the body 44 to be received in the elongated key slot 28. The fuel pump housing 12 is provided with a receiving hole 50 that is open to the cylindrical bore 14. The receiving hole 50 extends substantially perpendicular to the central axis 15 in the illustrated embodiment, and is sized to receive at least a portion of the guide key 40 therein.

As can be appreciated, the head 42 of the guide key 40 has an outer dimension along the central axis 15 of the cylindrical bore 14 that is larger than a dimension of the receiving hole 50 along the central axis 15. In particular, in the illustrated embodiment, the portion of the guide key 40 that extends into the cylindrical bore 14 has a dimension along the direction of reciprocation of the tappet assembly 20 which is larger than the dimension of the receiving hole 50 along the direction of reciprocation of the tappet assembly 20. Of course, the illustrated and described geometries of the guide key 40 and the receiving hole 50 are merely shown and discussed as an example, and the present invention is not limited thereto.

The guide key 40 of the illustrated embodiment also includes a support surface 46 that is defined by the head 42. When the guide key 40 is installed into the receiving hole 50, the support surface 46 contacts the bore wall surface 17 of the cylindrical bore 14 so that the head 42 of the guide key 40 is partially supported by the bore wall surface 17. This support contact distributes at least part of the bending stress caused by the reciprocal displacement of the tappet assembly 20 within the cylindrical bore 14 to be imparted on the guide key 40 to the bore wall surface 17.

In addition, as noted, the reciprocal displacement of the tappet assembly 20 within the cylindrical bore 14 causes contact stress to be imparted on the guide key 40 and/or the elongated key slots 28. Such contact stress can cause pins used in the prior art fuel pumps, or key slots to wear, which results in failure of the fuel pump. In contrast to the prior art, the head 42 of the guide key 40 has an elongated shape with an outer dimension along the central axis of cylindrical bore 14 that is larger than a dimension of the receiving hole 50. Thus, the contact area between the guide key 40 and the elongated key slots 28 are increased, the increased surface area of the head 42 effectively reducing the contact stress exerted on the head 42, and also reducing wear. Correspondingly, the reduction of contact stress exerted on the guide key 40, and distribution of bending stress to the bore wall surface 17 through the support surface 46 enhances the durability and reliability of the fuel pump 10, thus, reducing the failure rate of the guide key and incidences of rotation of the tappet assembly relative to the cam lobe.

In the above illustrated embodiment of FIG. 2, the receiving hole 50 may be sized slightly smaller in diameter than the diameter of a portion of the body 44 of the guide key 40 near the head 42. In such an embodiment, the guide key 40 would be press fitted into the receiving hole 50. It should be evident that the receiving hole 50 may be a blind hole that is open to the cylindrical bore 14 within the fuel pump housing 12. Alternatively, the receiving hole 50 may be a through-hole that extends through the fuel pump housing 12. Because the guide key 40 in accordance with the illustrated embodiment is provided with a head 42, the guide key 40 is prevented from backing out of the receiving hole 50 even if the receiving hole 50 is implemented as a through-hole. Moreover, in yet other embodiments, the receiving hole 50 may be angled relative to the bore wall surface 17. Of course, such an embodiment would require the guide key to be correspondingly shaped.

Figure 3A:
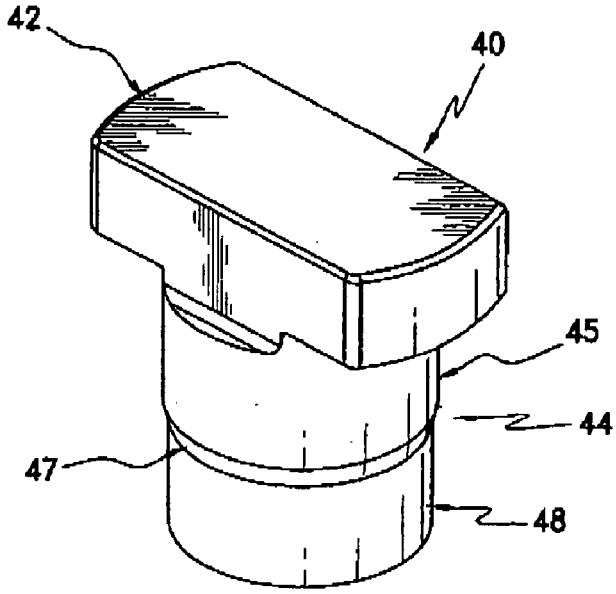
FIG. 3A is an enlarged perspective view of the guide key in accordance with one example implementation.
Figure 3B:
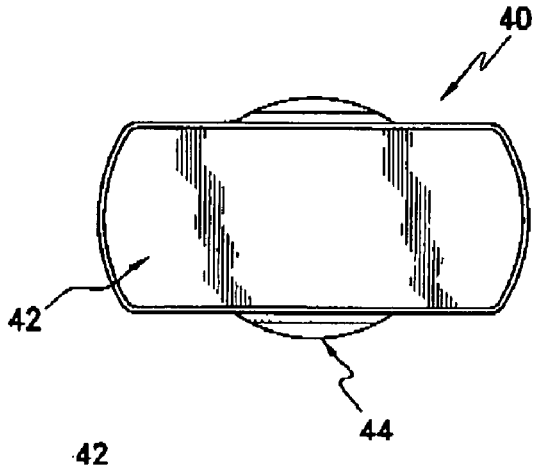
FIG. 3B is a top view of the guide key of FIG. 3A.
Figure 3C:
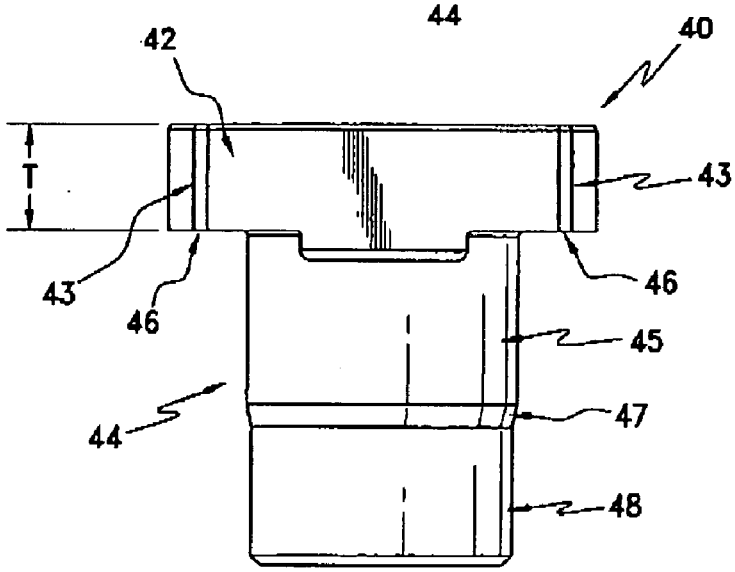
FIG. 3C is a front view of the guide key of FIG. 3A.

FIGS. 3A to 3C illustrate various views of the guide key 40 in accordance with one example implementation. As shown in these figures, the guide key 40 includes a body 44 that is sized to be at least partially received in the receiving hole provided in the fuel pump housing as previously described. In the illustrated embodiment, the body 44 of the guide key 40 is cylindrical with a substantially circular cross-section. The body 44 includes an enlarged portion 45 near the head 42 that has a diameter which is larger than the diameter of the reduced portion 48, and also larger than the diameter of the receiving hole 50 provided in the fuel pump housing 12 shown in FIG. 2. In such an embodiment, the guide key 40 is pressed into the receiving hole 50 to provide an interference fit with the receiving hole 50.

The reduced portion 48 of the guide key 40 is implemented with a diameter that is slightly smaller than the diameter of the receiving hole 50 to facilitate proper locating of the guide key 40 in the receiving hole 50 before press fitting the guide key 40 therein. In this regard, a chamfer 47 is also provided at the transition between the reduced portion 48 and the enlarged portion 45 of the body 44. The chamfer 47 facilitates proper insertion of the enlarged portion 45 of the body 44 into the receiving hole 50.

The head 42 of the guide key 40 extends into the cylindrical bore 14, as shown in FIG. 2, to be received in the elongated key slot 28 of the tappet assembly 20 in the manner previously described. Referring to FIG. 3C, the head 42 of the guide key 40 in the illustrated embodiment includes extensions 43 that extend perpendicular to the body 44 of the guide key 40, and extend diametrically opposed to one another in relation to the body 44. As noted, the head 42 includes contact surfaces 46 which are defined by the extensions 43 in the present embodiment. The support surfaces 46 contact the bore wall surfaces 17 of the cylindrical bore 14 in the manner previously described. The head 42 of the guide key 40 also increases the contact area for guiding the tappet assembly, correspondingly improving the guiding function, while reducing contact stress and corresponding wear.

Moreover, the head 42 of the guide key 40 greatly facilitates installation of the guide key 40 into the receiving hole 50. In particular, the head 42 of the guide key 40 can be manufactured, i.e. with an appropriate thickness T, so that when the support surface 46 contacts the bore wall surface 17, the head 42 protrudes into the cylindrical bore 14 the proper amount. Thus, by merely seating the head 42 of the guide key 40, proper depth positioning of the guide key 40 is easily attained, and the head 42 extends into the cylindrical bore 14 by a proper amount, i.e. by thickness T. Correspondingly, the illustrated embodiment of the present invention facilitates the installation process.

Of course, it should be noted that whereas the above described embodiment of the present invention is implemented with a guide key that has a substantially T-shaped cross-section, the present invention is not limited thereto, and the guide key may be implemented in any appropriate manner. As described, the T-shape of the guide key reduces the contact stress exerted on the guide key thereby reducing wear. Moreover, the guide key may be implemented to distribute at least a portion of the bending stress on the guide key that is caused by the reciprocating motion of the tappet assembly, to the bore wall surface of the cylindrical bore.

In view of the above description, it should also be evident that the present invention further provides a method of assembling a fuel pump. The arrangement of the fuel pump described allows for assembly of the camshaft and various other fuel pump components prior to the installation of the roller tappet assembly in the fuel pump housing. As can be appreciated, the assembly method includes providing a fuel pump housing with a cylindrical bore that has a central axis and is at least partially defined by a bore wall surface of the fuel pump housing. The method also includes forming a receiving hole in the fuel pump housing that is open into the cylindrical bore. The method further includes providing a guide key having a head, and inserting the body of the guide key into the receiving hole in a manner that the head of the guide key extends into the cylindrical bore. The head has an outer dimension along the central axis of the cylindrical bore that is larger than a dimension of the receiving hole along the central axis. The method also includes providing a tappet assembly including an outer peripheral surface and an elongated key slot extending longitudinally on the outer peripheral surface. The tappet assembly is inserted into the cylindrical bore with the key slot being positioned to receive the head of the guide key therein to maintain the rotational positioning of the tappet assembly.

As described above relative to the illustrated example, the head of the guide key may be provided with a support surface. Correspondingly, the method may also include at least partially distributing stress exerted on the guide key to the bore wall surface through the support surface as the tappet assembly is reciprocally displaced in the cylindrical bore.

Moreover, it should further be evident from the discussion above that another aspect of the present invention is a method for guiding a reciprocating tappet assembly in a fuel pump that improves the durability and the reliability of the fuel pump. The method includes providing a fuel pump housing with a cylindrical bore that has a central axis and is at least partially defined by a bore wall surface of the fuel pump housing. The method also includes forming a receiving hole in the fuel pump housing that is open into the cylindrical bore. A guide key is provided, the guide key having a head that extends into the cylindrical bore, the head having an outer dimension along the central axis of the cylindrical bore that is larger than a dimension of the receiving hole along the central axis. The method includes inserting at least a portion of the guide key into the receiving hole.

The method further includes providing a tappet assembly received in the cylinder bore, the tappet assembly including an outer peripheral surface and an elongated key slot longitudinally extending parallel to the central axis of the cylinder bore. The rotational positioning of the tappet assembly is maintained by receiving the head of the guide key in the elongated key slot of the tappet assembly. As described, the head of the guide key may be implemented to reduce the contact stress exerted on the guide key. In addition, the head of the guide key may be provided with a support surface, and the method may also include at least partially distributing the bending stress exerted on the guide key to the bore wall surface through the support surface.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. A fuel pump for an internal combustion engine comprising:

a fuel pump housing;

a cylindrical bore provided in said fuel pump housing, said cylindrical bore having a central axis, and being at least partially defined by a bore wall surface of said fuel pump housing;

a receiving hole formed in said fuel pump housing, said receiving hole being open to said cylindrical bore;

a tappet assembly received in said cylindrical bore, said tappet assembly including an outer peripheral surface with an elongated key slot longitudinally extending parallel to said central axis of said cylindrical bore; and a guide key partially received in said receiving hole and including a head that extends into said cylindrical bore to engage said elongated key slot of said tappet assembly, said head having an outer dimension along said central axis of said cylindrical bore that is larger than a dimension of said receiving hole along said central axis.

2. The fuel pump of claim 1, wherein said head of said guide key includes at least one extension sized to be received in said elongated key slot.

3. The fuel pump of claim 1, wherein said head of said guide key includes a support surface that contacts said bore wall surface.

4. The fuel pump of claim 1, wherein said receiving hole extends substantially perpendicular to said central axis, and said guide key includes a body that is at least partially received in said receiving hole.

5. The fuel pump of claim 4, wherein said body of said guide key has an enlarged portion having a circular cross section with a diameter that is larger than a diameter of said receiving hole so that said guide key is pressed into said receiving hole.

6. The fuel pump of claim 5, wherein said body of said guide key further includes a reduced portion having a circular cross section with a diameter that is smaller than said diameter of said receiving hole, and a chamfer between said reduced portion and said enlarged portion.

7. The fuel pump of claim 4, wherein said guide key has a substantially T-shape in which said head includes two extensions that extend perpendicular to said body and extend diametrically opposed to one another in relation to said body.

8. The fuel pump of claim 4, wherein said receiving hole is a through-hole extending through said fuel pump housing.

9. The fuel pump of claim 4, wherein said receiving hole is a blind hole open to said cylindrical bore.

10. A method for guiding a reciprocating tappet assembly in a fuel pump comprising:

providing a fuel pump housing with a cylindrical bore having a central axis and being at least partially defined by a bore wall surface of said fuel pump housing;

forming a receiving hole in said fuel pump housing, said receiving hole being open into said cylindrical bore;

providing a guide key with a head that extends into said cylindrical bore, said head having an outer dimension along said central axis of said cylindrical bore that is larger than a dimension of said receiving hole along said central axis;

inserting at least a portion of said guide key into said receiving hole;

providing a tappet assembly received in said cylinder bore, said tappet assembly including an outer peripheral surface and an elongated key slot longitudinally extending parallel to said central axis of said cylinder bore; and maintaining rotational positioning of said tappet assembly in said cylindrical bore by receiving said head of said guide key in said elongated key slot of said tappet assembly.

11. The method of claim 10, wherein said head of said guide key includes at least one extension that is slidably received in said elongated key slot to reduce contact stress exerted on said head as said tappet assembly is reciprocally displaced in said cylindrical bore.

12. The method of claim 10, wherein said head includes a support surface that contacts said bore wall surface, and said method further includes at least partially distributing bending stress exerted on said guide key to said bore wall surface through said support surface as said tappet assembly is reciprocally displaced in said cylindrical bore.

13. The method of claim 10, wherein said guide key includes a body having at least a portion with a circular cross section and a diameter larger than a diameter of said receiving hole, said method further including pressing in said body of said guide key into said receiving hole.

14. The method of claim 13, wherein said body of said guide key further includes a reduced portion having a circular cross section with a diameter that is smaller than said diameter of said receiving hole, and a chamfer between said reduced portion and said enlarged portion.

15. The method of claim 13, wherein said guide key has a T-shape in which said head comprises two extensions that extend perpendicularly to said body, and extend diametrically opposed to one another in relation to said body.

16. The method of claim 10, wherein said formed receiving hole is a through-hole.

17. The method of claim 10, wherein said formed receiving hole is a blind hole open to said cylindrical bore.

18. A method of assembling a fuel pump comprising:

providing a fuel pump housing with a cylindrical bore having a central axis and being at least partially defined by a bore wall surface of said fuel pump housing;

forming a receiving hole in said fuel pump housing, said receiving hole being open into said cylindrical bore;

providing a guide key having a head and a body, said head having an outer dimension along said central axis of said cylindrical bore that is larger than a dimension of said receiving hole along said central axis;

inserting said body of said guide key into said receiving hole in a manner that said head of said guide key extends into said cylindrical bore;

providing a tappet assembly including an outer peripheral surface and an elongated key slot extending longitudinally on said outer peripheral surface; and inserting said tappet assembly into said cylindrical bore with said key slot positioned to receive said head of said guide key therein to maintain rotational positioning of said tappet assembly.

19. The method of claim 18, wherein said head of said guide key includes at least one extension that is slidably received in said elongated key slot to reduce contact stress exerted on said head as said tappet assembly is reciprocally displaced in said cylindrical bore.

20. The method of claim 18, wherein said head of said guide key includes a support surface that contacts said bore wall surface, and said method further includes at least partially distributing bending stress exerted on said guide key as said tappet assembly is reciprocally displaced in said cylindrical bore to said bore wall surface through said support surface.

21. The method of claim 18, wherein said body of said guide key has at least a portion with a circular cross section having a diameter larger than a diameter of said receiving hole, said method further including press fitting said body of said guide key into said receiving hole.

22. The method of claim 20, wherein said body of said guide key further includes a reduced portion having a circular cross section with a diameter that is smaller than said diameter of said receiving hole, and a chamfer between said reduced portion and said enlarged portion.

23. The method of claim 18, wherein said guide key has a T-shape in which said head includes two extensions that extend perpendicular to said body and extend diametrically opposed to one another in relation to said body.

24. The method of claim 18, wherein said receiving hole is a through-hole extending through said fuel pump housing.

25. The method of claim 18, wherein said formed receiving hole is a blind hole open to said cylindrical bore.

* * * * *